US009110427B2

(12) United States Patent
Hashimoto et al.

(10) Patent No.: US 9,110,427 B2
(45) Date of Patent: Aug. 18, 2015

(54) IMAGE FORMING APPARATUS

(71) Applicants: Haruo Hashimoto, Osaka (JP); Kozo Yamazaki, Hyogo (JP)

(72) Inventors: Haruo Hashimoto, Osaka (JP); Kozo Yamazaki, Hyogo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/254,961

(22) Filed: Apr. 17, 2014

(65) Prior Publication Data

US 2014/0314440 A1 Oct. 23, 2014

(30) Foreign Application Priority Data

Apr. 18, 2013 (JP) ..... 2013-087388

(51) Int. Cl.
*G03G 15/00* (2006.01)
*G03G 21/16* (2006.01)

(52) U.S. Cl.
CPC ..... *G03G 15/757* (2013.01); *G03G 21/1619* (2013.01); *G03G 21/1647* (2013.01); *G03G 2215/0141* (2013.01)

(58) Field of Classification Search
CPC ..... G03G 21/1842; G03G 21/1853; G03G 21/1857; G03G 15/757
USPC ..... 399/107, 111, 117, 197
See application file for complete search history.

(56) References Cited

U.S. PATENT DOCUMENTS 6,198,891 B1 * 3/2001 Ishida et al. ..... 399/117
7,835,663 B2 * 11/2010 Tomatsu ..... 399/107

FOREIGN PATENT DOCUMENTS

| | | |
|---|---|---|
| JP | 2002-217560 | 8/2002 |
| JP | 2004-264705 | 9/2004 |
| JP | 2008-058342 | 3/2008 |
| JP | 2011-197407 | 10/2011 |

* cited by examiner

*Primary Examiner* — Erika J Villaluna
(74) *Attorney, Agent, or Firm* — Harness, Dickey & Pierce, P.L.C.

(57) ABSTRACT

An image forming apparatus includes a pair of side walls disposed opposite each other; a driven unit supported between the side walls; a drive unit with drive transmission gears attached to one of the side walls and drives the driven unit; and a reinforcing member connecting the pair of side walls. One end of the reinforcing member is attached to the side wall opposite the other side wall to which the drive unit is attached and the other end is attached to the drive unit. The driven unit is an image forming unit including at least an image carrier. The image carrier includes a rotary shaft, both lateral ends of which are supported by the pair of side walls. A gear portion engaging the drive transmission gears of the drive unit is disposed on one end of the rotary shaft of the image carrier.

8 Claims, 10 Drawing Sheets

IMAGE FORMING APPARATUS

CROSS-REFERENCE TO RELATED APPLICATION

The present application claims priority pursuant to 35 U.S.C. §119(a) from Japanese patent application number 2013-087388, filed on Apr. 18, 2013, the entire disclosure of which is incorporated by reference herein.

BACKGROUND

1. Technical Field

The present invention relates to an image forming apparatus such as a printer, a copier, a facsimile machine, or a multi-function apparatus having one or more capabilities of the above devices.

2. Related Art

Image forming apparatuses are known in which units such as image forming units and drive units are supported between a pair of side walls that form part of the body of the apparatus. In this type of image forming apparatus, the image forming units, drive units, and the like are installed in the apparatus so as to reduce the overall size of the package during shipping.

However, with such an arrangement, any impact to the apparatus during shipping may cause the side walls to deform even temporarily, thereby displacing the units or at worst dislodging them altogether.

Various approaches have been tried to prevent such dislodgment, such as reinforcing the side walls to improve rigidity, or using a binder to fix the units in place during shipping alone (see, for example, JP-2008-58342-A and JP-5062276-B).

Provision of a reinforcing member as described above may prevent deformation of the apparatus body and therefore reduce displacement of units. However, to completely prevent deformation of the apparatus body is difficult even with a reinforcing member.

SUMMARY

The present invention provides an optimal image forming apparatus capable of reducing displacement between drive units. The present invention provides an image forming apparatus that includes a pair of side walls disposed opposite each other; a driven unit supported between the side walls; a drive unit disposed on one side wall of the pair of side walls to drive the driven unit; and a reinforcing member connecting the pair of side walls. In such an image forming apparatus, one end of the reinforcing member is connected to the other side wall opposite the side wall on which the drive unit is mounted and the other end of the reinforcing member is connected to the drive unit, thereby enabling the drive unit to displace with the deformation of the apparatus body and thus maintaining the relative positions of the drive unit and the driven unit.

These and other objects, features, and advantages of the present invention will become apparent upon consideration of the following description of the preferred embodiments of the present invention when taken in conjunction with the accompanying drawings.

DETAILED DESCRIPTION

Figure 1:
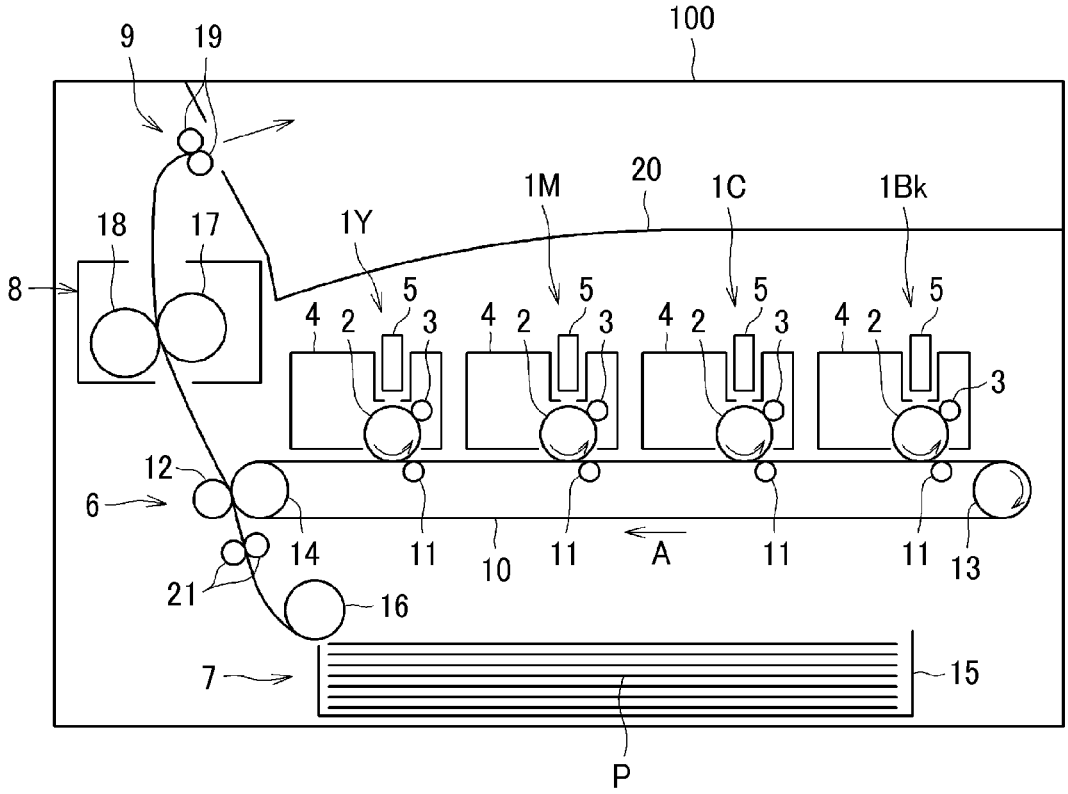
FIG. 1 illustrates an image forming apparatus according to an embodiment of the present invention.

Hereinafter, the present invention is described referring to accompanying drawings. In each figure illustrating the present invention, a part or component having the same function or shape is applied with the same reference numeral, and once explained, a duplicated description thereof is omitted.

FIG. 1 is a schematic view of an image forming apparatus illustrating an embodiment of the present invention. First, with reference to FIG. 1, a whole structure and operation of an image forming apparatus according to an embodiment of the present invention is described.

As illustrated in FIG. 1, four process units 1Y, 1M, 1C, and 1Bk each as an image forming unit are detachably attached to an apparatus body 100. Each of the process units 1Y, 1M, 1C, and 1Bk has the same structure except that each includes a different color of developer such as yellow (Y), magenta (My, cyan (C), and black (Bk) that corresponds to RGB color separation component of a color image.

Specifically, each of the process units 1Y, 1M, 1C, and 1Bk includes a photoreceptor 2 as a latent image carrier; a charging roller 3 to charge a surface of the photoreceptor 2; a developing device 4 to render a latent image formed on the photoreceptor 2 visible; and a cleaner (not shown) to clean the surface of the photoreceptor 2, which together form a process unit. In addition, each LED head array 5 to expose each surface of the photoreceptor 2 and form the latent image thereon is disposed so as to oppose to each photoreceptor 2.

In addition, the image forming apparatus includes a transfer device 6 to transfer an image onto a sheet of paper (hereinafter, simply a sheet) as a recording medium, a sheet feeder 7 to feed the sheet, a fuser 8 to fix the image that is transferred to the sheet, and a sheet discharger 9 to discharge the sheet outside the apparatus.

The transfer device 6 includes an intermediate transfer belt 10 serving as an intermediate transfer body; a primary transfer roller 11 serving as a primary transfer member; and a secondary transfer roller 12 as a secondary transfer member. The intermediate transfer belt 10 is formed of an endless belt and is stretched around a drive roller 13, a driven roller 14, and a plurality of primary transfer rollers 11. When the drive roller 13 rotates in the clockwise direction as shown in the figure, the intermediate transfer belt 10 is driven to rotate in a direction as indicated by Arrow A in the figure.

Each primary transfer roller 11 is disposed opposite each photoreceptor 2 and contacts an interior surface of the intermediate transfer belt 10. With this structure, each photoreceptor 2 and the intermediate transfer belt 10 contact each other to thus form a primary transfer nip. Each primary transfer roller 11 is connected to a power source, not shown, and is supplied with a predetermined direct current (DC) voltage and/or alternating current (AC) voltage.

The secondary transfer roller 12 is disposed at a position opposed to the driven roller 14 and contacts an external surface of the intermediate transfer belt 10 to form an area of contact between the secondary transfer roller 12 and the intermediate transfer belt 10 herein referred to as a secondary transfer nip portion. In addition, similarly to the primary transfer rollers 11, the secondary transfer roller 12 is connected to a power source, not shown, and is supplied with a predetermined DC voltage and/or AC voltage.

The sheet feeder 7 includes a paper tray 15 to contain a plurality of sheets P and a sheet feed roller 16 to convey each sheet P from the paper tray 15. A pair of registration rollers 21 to convey the sheet P to the secondary transfer nip at an appropriate timing is disposed downstream in the sheet conveyance direction of the sheet feed roller 16. Herein, the sheet P includes various types of sheets such as a sheet of cardboard, a postcard, an envelope, plain paper, thin paper, coated paper or art paper, tracing paper, and the like. An OHP sheet or film may be used as recording media other than the normal sheet.

The fuser 8 includes a fuser roller 17 as a fusing member and a pressure roller 18 as a pressure applying member. The fuser roller 17 is heated by a heat source, not shown, of a heater and the like. The pressure roller 18 is pressed against the fuser roller 17 so as to contact the fuser roller 17, thereby forming an area of contact between the pressure roller 18 and the fuser roller 17 that is herein referred to as a fixing nip.

The sheet discharger 9 includes a pair of sheet discharge rollers 19. The sheet P is discharged outside the apparatus by the sheet discharge rollers 19 and is stacked on a sheet discharge tray 20 formed as an indentation in the top surface of the apparatus body 100.

Next, with reference to FIG. 1, operation of the image forming apparatus according to the present embodiment is described.

When an image forming operation is started, the photoreceptor 2 of each of the process units 1Y, 1M, 1C, and 1Bk is driven to rotate in the counterclockwise direction in FIG. 1 and the surface of each photoreceptor 2 is uniformly charged at a predetermined polarity by the charging roller 3. Based on image data from an image reader or a computer, not shown, the charged surface of each photoreceptor 2 is exposed to the exposure light from the LED head array 5 and an electrostatic latent image is formed on the charged surface of each photoreceptor 2. In this case, the image data exposed on each photoreceptor 2 is monochrome image data decomposed from the target full-color image into color data of yellow, magenta, cyan, and black. Each developing device 4 supplies toner to the electrostatic latent image formed on the photoreceptor 2, and the electrostatic latent image is visualized as a toner image.

When the image forming operation is started, the drive roller 13 around which the intermediate transfer belt 10 is stretched starts to rotate and the intermediate transfer belt 10 starts rotation. In addition, because a constant voltage or a constant-current-controlled voltage with a polarity opposite that of the toner is applied to each of the primary transfer rollers 11, a transfer electric field is formed in the primary transfer nip between each of the primary transfer rollers 11 and each photoreceptor 2.

Thereafter, upon the toner image of each color formed on the photoreceptor 2 reaches the primary transfer nip associated with the rotation of each photoreceptor 2, the toner image of each color formed on each photoreceptor 2 is sequentially transferred in a superposed manner on the intermediate transfer belt 10 by the transfer electric field created in the primary transfer nip. Thus, a full-color toner image is carried on the surface of the intermediate transfer belt 10. In addition, the residual toner which has not been transferred to the intermediate transfer belt 10 is removed by a not-shown cleaning blade.

When the image forming operation is resumed, the sheet feed roller 16 begins to rotate and another sheet P is sent out from the paper tray 15. The conveyance of the sent-out sheet P is temporarily stopped by the registration roller pair 21. Then, the registration roller pair 21 starts to rotate at a predetermined timing so that the sheet P is conveyed to the secondary transfer nip in sync with which the toner image on the intermediate transfer belt 10 reaches the secondary transfer nip.

In this case, because the transfer voltage having a polarity opposite that of the charged toner of the toner image on the intermediate transfer belt 10 is applied to the secondary transfer roller 12, a transfer electric field is created in the secondary transfer nip. Through the electric transfer field formed at the secondary transfer nip, the toner image on the intermediate transfer belt 10 is transferred en bloc to the sheet P. In addition, residual toner that has not been transferred to the sheet P and is remaining on the intermediate transfer belt 10 is removed by a not-shown belt cleaning device.

Thereafter, the sheet P to which the toner image has been transferred is conveyed to the fuser 8 and the toner image on the sheet P passes through the fixing nip between the fuser roller 17 and the pressure roller 18, whereby the toner image on the sheet P is heated and pressed, and is fixed on the sheet P. The sheet P is then discharged outside the apparatus by the pair of sheet discharge rollers 19 and is stacked on the sheet discharge tray 20.

The description heretofore relates to an image forming operation when a frill-color image is formed on the sheet. However, alternatively, a monochrome image may be formed using any one of the four process units 1Y, 1M, 1C, and 1Bk and an image using two or three colors may be formed by using two or three process units.

Figure 2:
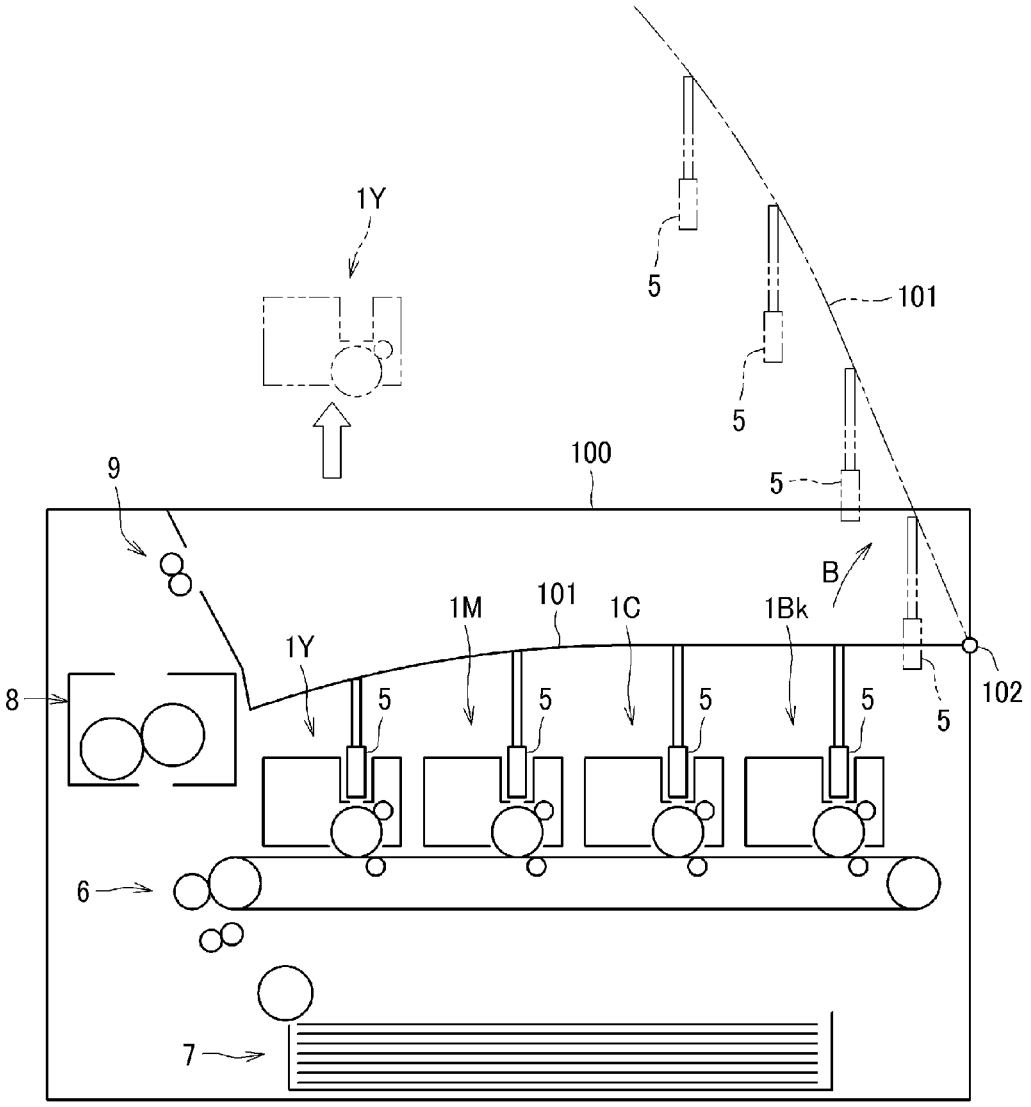
FIG. 2 is a view of the image forming apparatus illustrating how to attach each process unit.

As illustrated in FIG. 2, the upper cover 101 is rotatable about a hinge 102. When the upper cover 101 is rotated in Arrow B-direction in the figure, an upper portion of the apparatus body 100 is open. The LED head array 5 is held below the upper cover 101. When the upper cover 101 is open, the LED head arrays 5 are in a state retracted from the process units 1Y, 1M, 1C, and 1Bk. Thus, by retracting the LED head arrays 5 together with the upper cover 101, the process units 1Y, 1M, 1C, and 1Bk can be detached from the apparatus body 100 from above without interfering with the LED head arrays 5.

Figure 3:
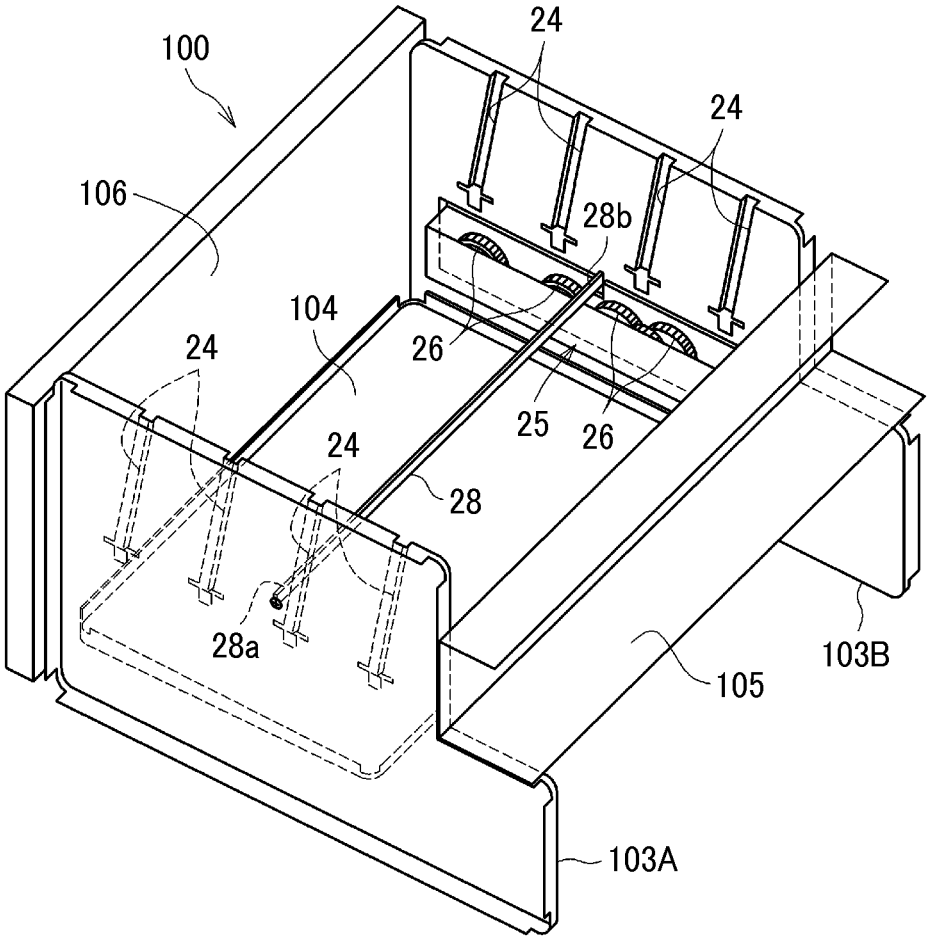
FIG. 3 is a perspective view of the apparatus body.
Figure 4:
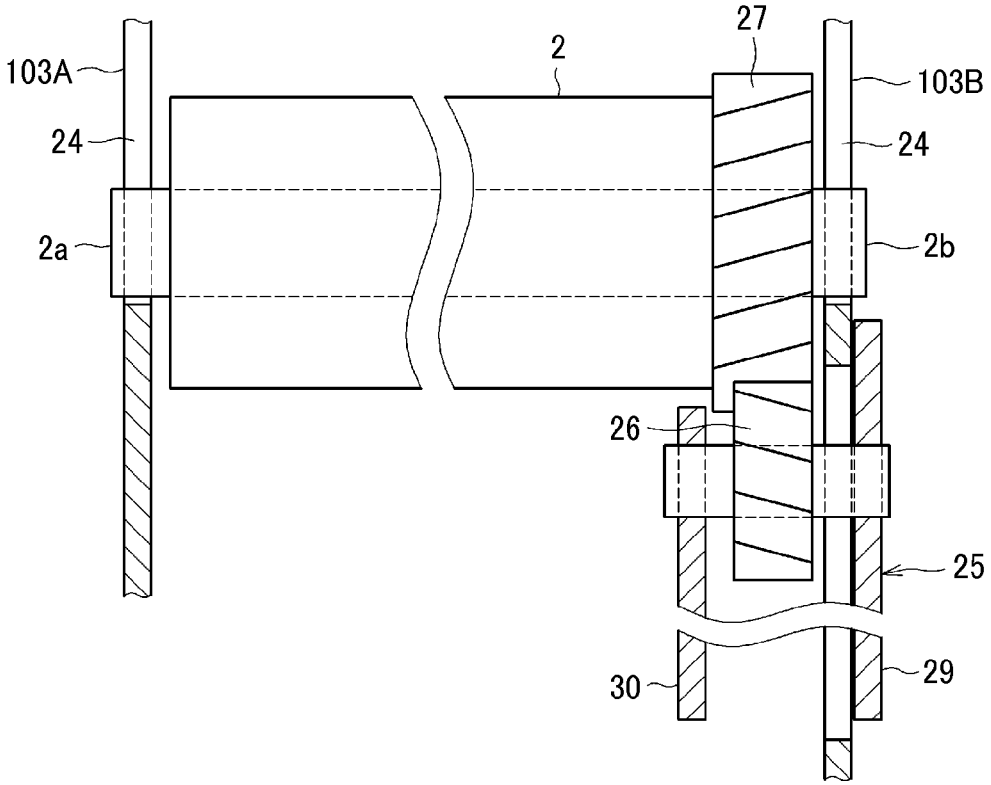
FIG. 4 is a cross-sectional view of the apparatus body.

Next, a description is given of the construction of the apparatus body referring to FIGS. 3 and 4. FIG. 3 is a perspective view of the apparatus body and FIG. 4 is a cross-sectional view thereof.

As illustrated in FIG. 3, the apparatus body 100 mainly includes a pair of side walls 103A and 103B, a bottom wall 104 that connects the side walls at a lower portion, a front wall 105 that connects the side walls at a front side, and a rear wall 106 that connects the side walls at a rear side. FIG. 3 does not show the upper cover 101 for simplification. The bottom wall 104, the front wall 105, and the rear wall 106 are fixed with screws relative to both side walls 103A and 103B.

A plurality of vertically extending grooves 24 to guide the process unit when attaching and detaching it is formed in inner surfaces of the side walls 103A and 103B. In the present embodiment, the process unit 1 is guided by moving both ends 2*a* and 2*b* of a rotary shaft of the photoreceptor 2 along the grooves 24 (see FIG. 4).

As illustrated in FIG. 3, a drive unit 25 to drive the process unit 1 is disposed on the side wall 103B on one side of the apparatus body. The drive unit 25 includes a plurality of drive transmission gears 26 that transmit driving force to the photoreceptor 2 of each process unit 1. On the other hand, a gear portion 27 engaging with the drive transmission gears 26 of the drive unit 25 is disposed on one end 2*b* of the rotary shaft of the photoreceptor 2 (see FIG. 4). In a state in which the process unit 1 is attached to the apparatus body 100, the gear portion 27 of each photoreceptor 2 engages each drive transmission gear 26 of the drive unit 25, so that the driving force can be transmitted from a drive source, not shown. In addition, in a state in which the process unit 1 is attached to the apparatus body 100, both ends 2*a* and 2*b* of the rotary shaft of the photoreceptor 2 contact lower ends of the grooves 24, so that the process unit 1 is retained between the side walls 103A and 103B.

A reinforcing member 28 to reinforce the apparatus body 100 is disposed between the side walls 103A and 103B. In the present embodiment, the reinforcing member 28 is disposed in the center in the distal direction of the side walls 103A and 103B and both walls 103A and 103B are connected by the reinforcing member 28. However, alternatively the reinforcing member of the present invention is different from the embodiment as disclosed, for example, by JP-2008-58342-A, in which the reinforcing member simply and directly connects the side walls. In the present embodiment, one end 28*a* of the reinforcing member 28 is directly attached to the side wall 103A (which is opposite the side wall 103B to which the drive unit 25 is attached), but the other end 28*b* of the reinforcing member 28 is attached to the drive unit 25.

According to the present invention, because the other end of the reinforcing member is connected to the drive unit, even when the apparatus body is deformed, the drive unit may be displaced following the deformation of the apparatus body.

As a result, followability of the drive unit relative to the driven unit is improved. It is therefore possible to reduce relative positional displacement between the drive unit and the driven unit.

Figure 5:
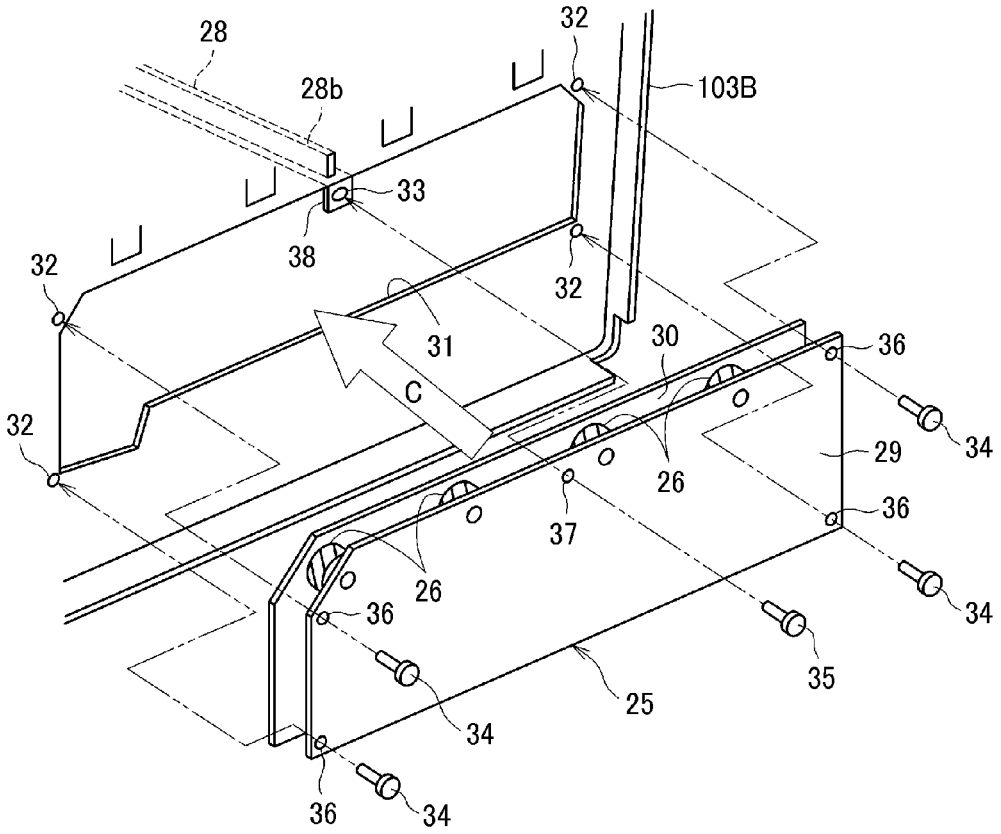
FIG. 5 is a view of the image forming apparatus illustrating how to attach a drive unit.
Figure 6:
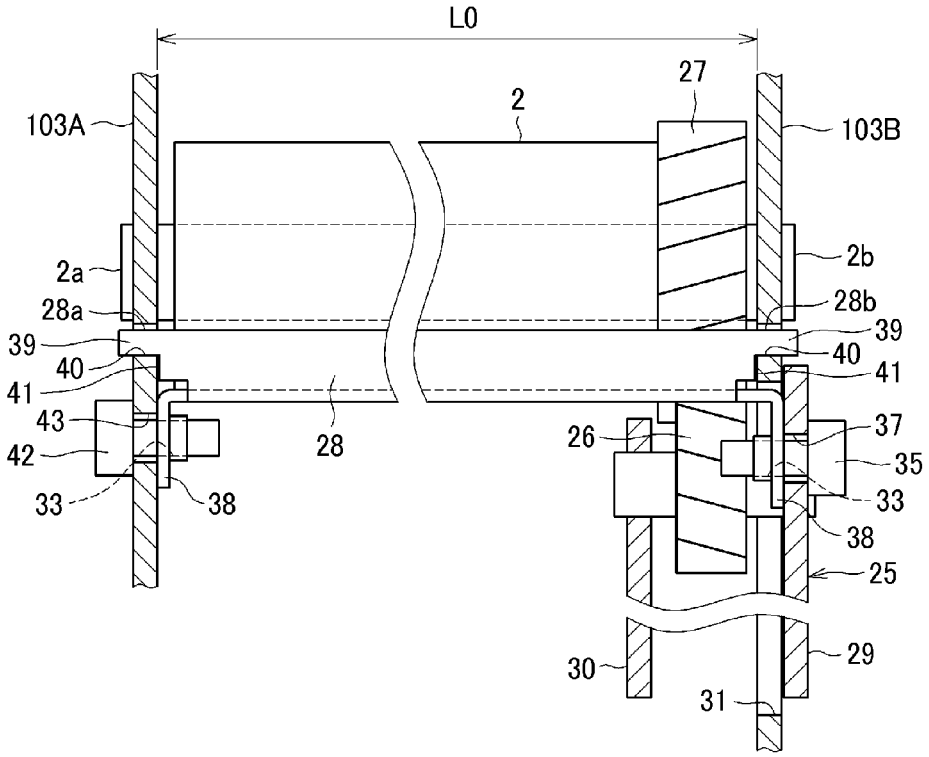
FIG. 6 is a cross-sectional view of the apparatus body showing where a reinforcing member is attached.

Next, a description is given of a structure and method for mounting the reinforcing member 28 and the drive unit 25 referring to FIGS. 5 and 6. FIG. 5 is a view illustrating how to attach the drive unit and FIG. 6 is a cross-sectional view of the apparatus body at a position in which a reinforcing member is attached.

As illustrated in FIG. 5, the drive unit 25 includes an outer frame 29 and an inner frame 30. The plurality of drive transmission gears 26 and a drive source, not shown, are sandwiched and supported by frames 29 and 30. On the other hand, the side wall 103B to which the drive unit 25 is attached includes an opening 31 through which the inner frame 30 can be inserted from outside in Arrow C direction. Then, around the circumference of the opening 31, a plurality of screw holes 32 to screw the drive unit 25 to the inner frame 30 is disposed.

A screw hole 33 to screw the drive unit 25 is disposed at the end 28*b* of the reinforcing member 28 that is attached to the drive unit 25. More specifically, a flange 38 bent and extending downward from the end 28*b* of the reinforcing member 28 is provided, and the screw hole 33 is formed in the flange 38. By providing the screw hole 33 in the flange 38 bent downward, in a state in which the reinforcing member 28 is supported by the pair of side walls 103A and 103B, the screw hole 33 is exposed from the opening 31 of the side wall 103B. In addition, a plurality of through-holes 36, 37 is disposed on the outer frame 29 of the drive unit 25 at positions corresponding to respective screw holes 32, 33. The screws 34, 35 pass through the through-holes 36, 37.

As illustrated in FIG. 6, insertion portions 39 protruding toward outside of each side wall 103A, 103B are disposed at both ends 28*a*, 28*b* of the reinforcing member 28. Insertion holes 40 are disposed on the side walls 103A and 103B. The insertion portions 39 can be inserted into the insertion holes 40. Further, contact portions 41 to abut an interior wall of the side walls 103A and 103B are disposed on both ends 28*a*, 28*b* of the reinforcing member 28.

On the left in FIG. 6, a flange 38 which is bent downward similarly to the flange 38 disposed on the end 28*b* in the opposite side, is disposed on the end 28*a* of the reinforcing member 28. The flange 38 also includes a screw hole 33. A through-hole 43 that passes through a screw 42 is disposed on the side wall 103A on the left in the figure at a position corresponding to the screw hole 33 of the reinforcing member 28.

Next, referring to FIGS. 5 and 6, a description is given of a method to mount the reinforcing member 28 and the drive unit 25 in the apparatus body.

First, as illustrated in FIG. 6, both insertion portions 39 of the reinforcing member 28 are inserted into each insertion hole 40 on the side walls 103A and 103B, and both ends 28*a*, 28*b* of the reinforcing member 28 are supported by the side walls 103A and 103B.

Next, as illustrated in FIG. 5, the drive unit 25 is inserted from the opening 31 of the side wall 103B and is positioned such that the through-holes 36, 37 disposed on the outer frame 29 are aligned with the screw holes 32, 33 disposed on the side wall 103B and the reinforcing member 28. In this state, the inner frame 30 and the drive transmission gears 26 are disposed at an inner side of the side wall 103B and the outer frame 29 is disposed at an outer side of the side wall 103B (see FIG. 6). Then, the screws 34, 35 are inserted into the through-holes 36, 37 from outside of the side wall 103B, so as to be joined with the screw holes 32, 33. Thus, the drive unit 25 is fixed with respect to the reinforcing member 28 and the side wall 103B.

Similarly, the reinforcing member 28 is fixed on the other side wall 103A by inserting the screw 42 from outside into the through-hole 43 to be joined with the screw hole 33 of the reinforcing member 28. As a result, both ends 28*a*, 28*b* of the reinforcing member 28 are fixed to both side walls 103A and 103B. Further, contact portions 41 to abut an interior wall of the side walls 103A and 103B are disposed on both ends 28*a*, 28*b* of the reinforcing member 28. By fastening the screws 35, 42 at both sides with the reinforcing member 28, the contact portions 41 of the reinforcing member 28 contact each interior surface of both side walls 103A and 103B. With this structure, an interval between both side walls 103A and 103B is defined at a predetermined distance L0 (see FIG. 6).

Mounting the reinforcing member 28 and the drive unit 25 is thus complete. In the present embodiment, assembly can be performed from outside of the side walls 103A and 103B, thereby improving workability and facilitating assembly.

Figure 7:
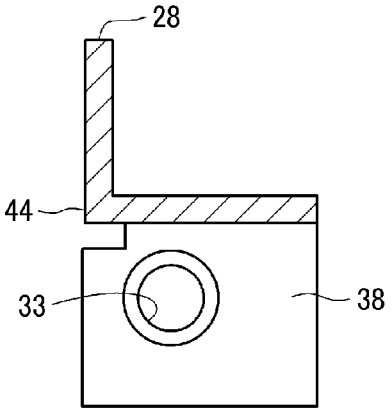
FIG. 7 is a cross-sectional view of the reinforcing member sectioned in a direction perpendicular to a longitudinal direction thereof.

FIG. 7 is a cross-sectional view of the reinforcing member sectioned in a direction perpendicular to a longitudinal direction thereof.

As illustrated in FIG. 7, the reinforcing member 28 according to the present embodiment includes a bent portion 44 as seen from the cross-section in the direction perpendicular to the longitudinal direction thereof. More specifically, the reinforcing member 28, formed of sheet metal, is subjected to a bending process to form the bent portion 44. Provision of the bent portion 44 strengthens the sheet metal against an impact in the direction crossing the longitudinal direction thereof compared to the plain sheet metal without the bent portion 44.

In FIG. 7, the bent portion 44 forms a 90-degree angle. Alternatively, however, the angle may be other than the right angle and the bent portion 44 may be formed into a twisted shape. To further improve the strength, the reinforcing member 28 may include more than one bent portion 44 in its cross-section thereof. Moreover, the reinforcing member 28 may be either a square bar shape or a round bar shape.

Figure 10:
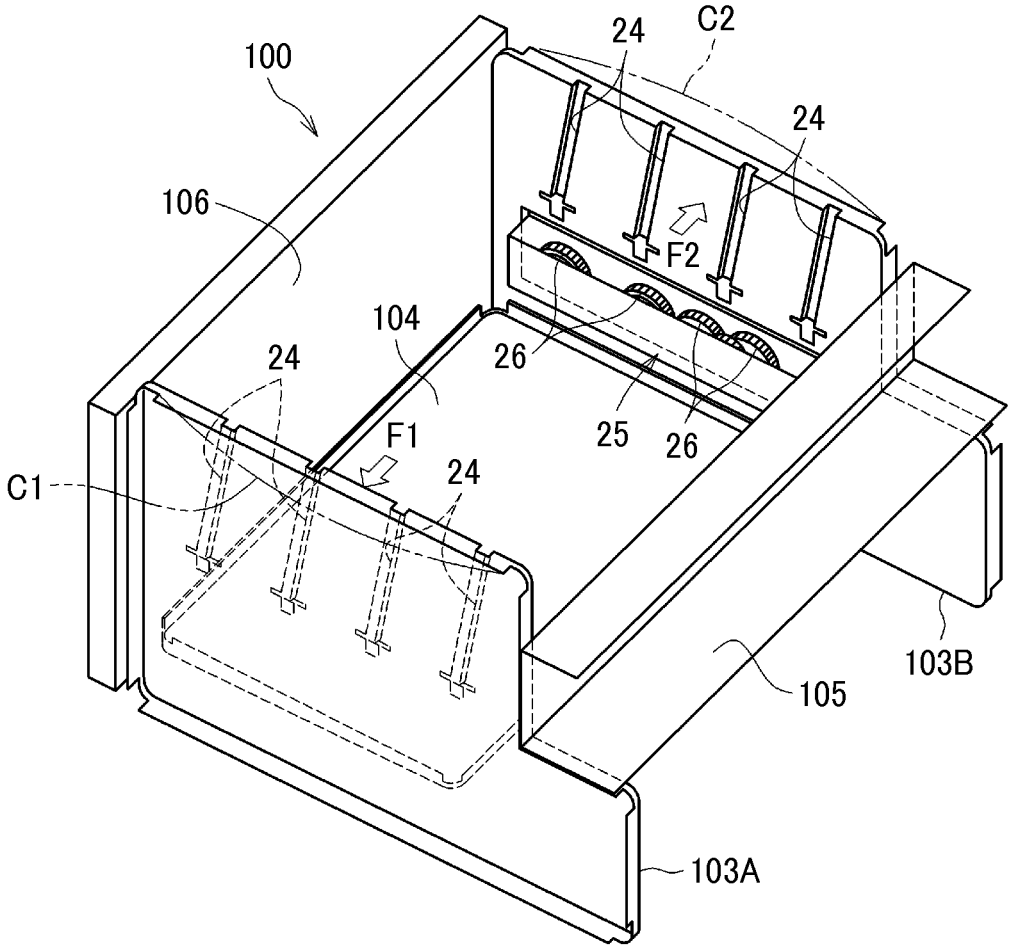
FIG. 10 BACKGROUND ART
FIG. 10 is a perspective view of the apparatus body according to a comparative example.
Figure 11:
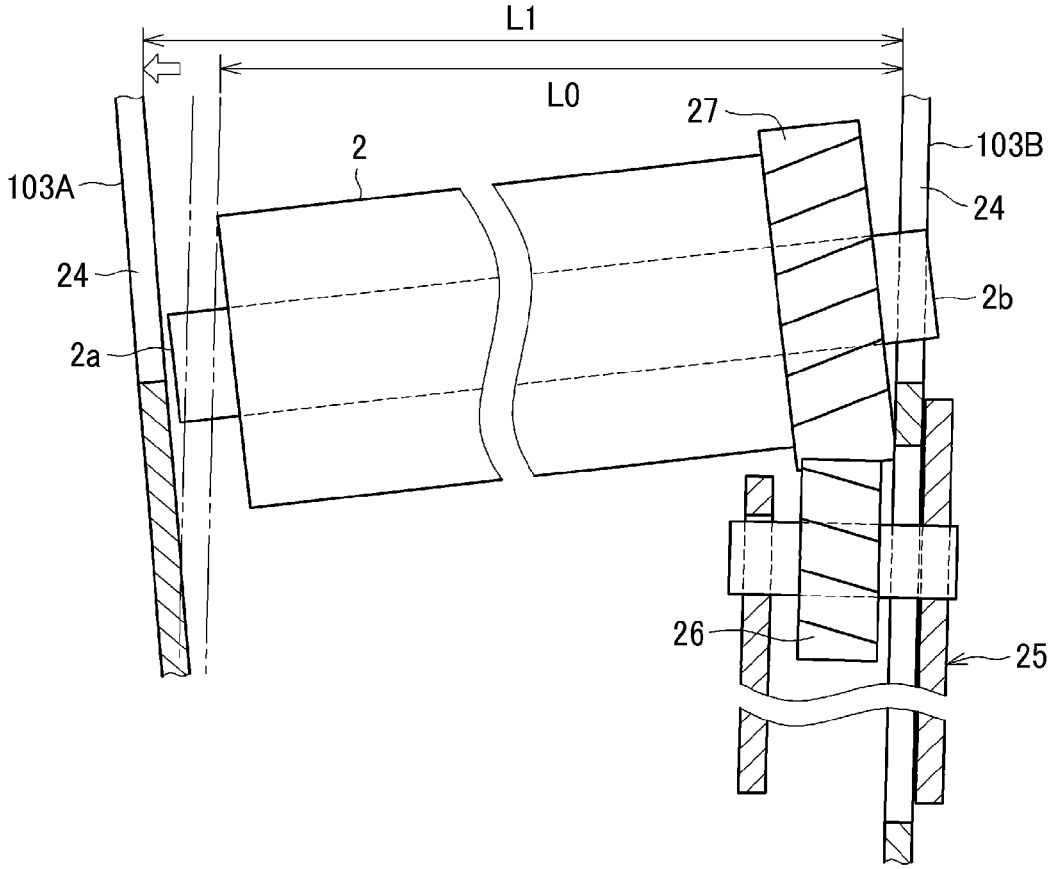
FIG. 11 BACKGROUND ART
FIG. 11 illustrates deformation of the apparatus body according to the comparative example.

FIG. 10 is a perspective view of an apparatus body according to a comparative example in which no reinforcing member 28 is disposed and FIG. 11 illustrates deformation of the apparatus body according to the comparative example.

As illustrated in FIG. 10, in the comparative example, the side walls 103A and 103B are not connected by the reinforcing member 28, and, for example, when an impact F1 or F2 is applied to the apparatus body during delivery, the side walls 103A and 103B may bend greatly, as shown by broken lines C1 and C2. In particular, the side walls 103A and 103B are connected with the front wall 105 and the rear wall 106 in the distal direction, the side walls 103A and 103B tend to greatly bend in the center in the distal direction.

Then, as illustrated in FIG. 11, one side wall 103A greatly inclines due to bending toward the other side wall 103B. When the distance between the side walls 103A and 103B increases from L0 to L1, one end 2*a* of the photoreceptor 2 falls from the grooves 24 of the side wall 103A. Further, engagement between the gear portion 27 of the photoreceptor 2 and the drive transmission gears 26 of the drive unit 25 is disrupted. As a result, the gear portion 27 and the drive transmission gears 26 are damaged, the distance between rotary shafts of the gear portion 27 and the drive transmission gears 26 changes, and optimal and stable drive transmission becomes impossible, resulting in a low-quality image with density fluctuation caused by a defective gear engagement pitch, that is, a so-called banding.

Figure 8:
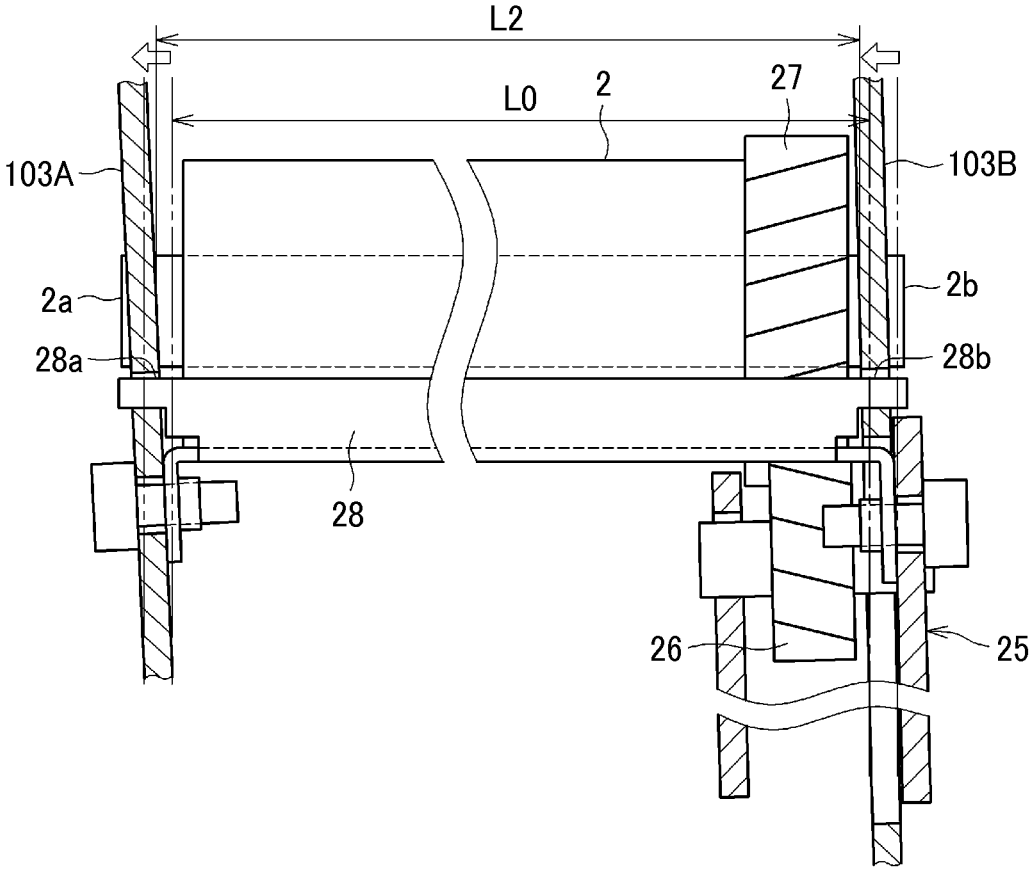
FIG. 8 is a view for describing an effect of the embodiment of the present invention.

By contrast, as illustrated in FIG. 8, according to the present invention, the side walls 103A and 103B are connected with the reinforcing member 28, thereby preventing one side wall 103A from greatly bending relative to the other side wall 103B. More specifically, because both side walls 103A and 103B are connected with the reinforcing member 28, even though one side wall 103A inclines outward, the other side wall 103B inclines in the same direction as the side wall 103A. Accordingly, the distance between the side walls 103A and 103B can be maintained with substantially no change from L0 to L2. As a result, a positional error of the photoreceptor 2 due to the deformation of the apparatus body may be prevented. Moreover, because the reinforcing member 28 is disposed in the center in the distal direction of the side walls 103A and 103B, changes in the distance between the side walls 103A and 103B being greater in the center position may be prevented effectively.

Furthermore, because the other end 28*b* of the reinforcing member 28 is attached to the drive unit 25, the drive unit 25 may be displaced following the inclination of the side walls 103A and 103B. With this structure, because the drive unit 25 can follow the photoreceptor 2 that displaces in accordance with the inclination of the side walls 103A and 103B, displacement in the distance between rotary shafts of the gear portion 27 of the photoreceptor 2 and the drive transmission gears 26 of the drive unit 25, or relative positional displacement in the shaft direction may be reduced. As such, according to the present invention, even though the apparatus body is deformed, a change in the relative positions of the photoreceptor 2 or the process unit 1 and the drive unit 25 can be reduced, thereby maintaining the engagement of the gear portion 27 with the drive transmission gears 26 and stable drive transmission. As a result, a quality image without any defect such as banding may be obtained.

Figure 9:
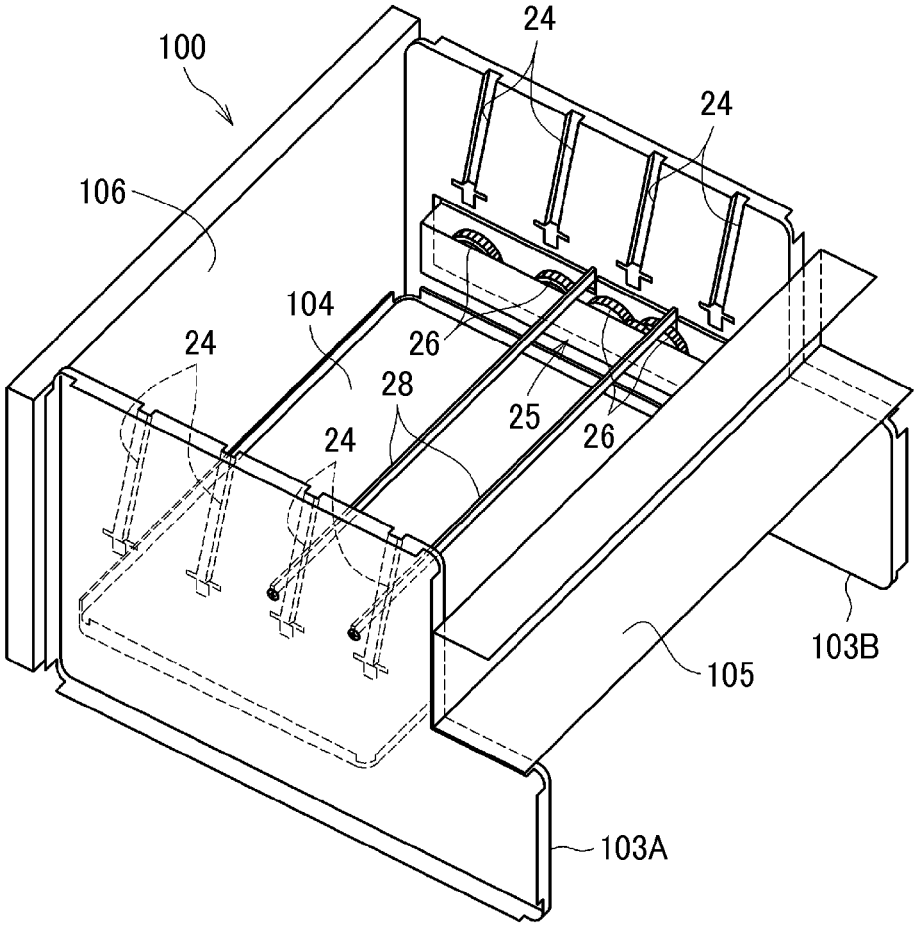
FIG. 9 is a view illustrating another embodiment of the present invention including a plurality of reinforcing members.

The present invention is not limited to the embodiments described heretofore, and can be applied to other embodiments modified in a range without distorting from the concept of the present invention. Thus, for example, FIG. 9 illustrates an example in which a plurality of reinforcing members 28 is disposed to further improve the strength of the apparatus body.

In addition, a structure for reducing relative positional error between the driven unit and the drive unit by using the process unit and the drive unit as an example has been described in the present embodiment. Alternatively, other than the process unit, a toner collection device including a conveyance screw or the fuser device may be employed as a driven unit. More generally, the image forming apparatus according to the embodiments of the present invention is not limited to the apparatus as illustrated in FIG. 1, and may be applied to any other type of copier, printer, facsimile machine, or the multifunction apparatus having the functions of the above devices in combination.

Additional modifications and variations of the present invention are possible in light of the above teachings. It is therefore to be understood that, within the scope of the appended claims, the invention may be practiced other than as specifically described herein.

What is claimed is:

1. An image forming apparatus having an apparatus body, comprising:

a pair of side walls disposed opposite each other, the side walls forming part of the apparatus body;

a driven unit supported between the pair of side walls;

a drive unit comprising drive transmission gears, disposed on one of the pair of side walls and configured to drive the driven unit; and a reinforcing member connecting the pair of side walls, a first end of the reinforcing member attached to a side wall opposite a side wall to which the drive unit is attached, a second end of the reinforcing member attached to the drive unit, the drive unit further comprising a frame to which the second end of the reinforcing member is attached, the frame being positioned on an outer side of the side wall to which the drive unit is attached.

2. The image forming apparatus as claimed in claim 1, wherein the driven unit is an image forming unit comprising an image carrier, the image carrier comprising:

a rotary shaft, both lateral ends of which are supported by the pair of side walls; and a gear portion engaging the chive transmission gears of the drive unit, disposed on one end of the rotary shaft of the image carrier.

3. The image forming apparatus as claimed in clam 1, wherein the pair of side walls comprises insertion holes therein and the reinforcing member comprises:

insertion portions insertable in the insertion holes; and contact portions to abut an interior wall of the side walls, disposed at both ends of the reinforcing member.

4. The image forming apparatus as claimed in claim 1, further comprising a front wall, and a rear wall, wherein the front wall connects the pair of side walls at a front side, and the rear wall connects the pair of side walls at a rear side, wherein the reinforcing member, disposed between the side walls, connects the pair of side walls.

5. The image forming apparatus as claimed in claim 1, wherein, in a state in which both ends of the reinforcing member are supported by the pair of side walls, the drive unit is mountable with screws insertable from outside the pair of side walls.

6. The image forming apparatus as claimed in claim 5, wherein one wall of the pair of side walls has an opening therein through which the drive unit can be inserted into the apparatus from outside the apparatus body.

7. The image forming apparatus as claimed in claim 1, wherein the reinforcing member includes a bent portion bent in a direction substantially perpendicular to a longitudinal direction of the reinforcing member.

8. The image forming apparatus as claimed in claim 1, comprising a plurality of reinforcing members.

* * * * *